United States Patent [19]

Satake et al.

[11] 3,959,030

[45] May 25, 1976

[54] METHOD OF PRODUCING ALUMINUM COATED STEEL

[75] Inventors: Jiro Satake, Ibaraki; Saburo Nagata, Kobe; Katsuyasu Kawasaki, Takatsuki, all of Japan

[73] Assignee: Sumitomo Metal Industries, Ltd., Japan

[22] Filed: Dec. 30, 1974

[21] Appl. No.: 537,327

[52] U.S. Cl. ..... 148/12 R; 427/292; 427/328; 427/370; 427/383; 427/427

[51] Int. Cl.[2] ..... C21D 7/14; B05D 1/02

[58] Field of Search ..... 427/309, 422, 423, 427, 427/383, 320, 292, 360, 370; 148/131, 12 R

[56] References Cited

UNITED STATES PATENTS

| | | | |
|---|---|---|---|
| 2,490,543 | 12/1949 | Robertson et al. | 427/422 |
| 2,797,174 | 6/1957 | Mozley et al. | 427/427 |
| 2,845,366 | 7/1958 | Schroeder | 427/427 |
| 3,079,275 | 2/1963 | Holowaty | 427/427 |
| 3,400,010 | 9/1968 | Keating | 427/427 |

*Primary Examiner*—Cameron K. Weiffenbach
*Attorney, Agent, or Firm*—Watson, Cole, Grindle & Watson

[57] ABSTRACT

There is disclosed a method for producing aluminum coated steel comprising cleaning the surface of a steel substrate by grid- or shot-blasting or by pickling followed by rinsing with water and thermal spraying with aluminum thereon in a thickness ranging from 30 to 300 microns while heating said surface sufficiently to maintain it at a temperature ranging from about 100° to 500°C.

The aluminum coated steel may be thereafter be treated by heating it at a temperature ranging from 150° to 600°C for 3 minutes to 24 hours after it has been cold-rolled to a reduction of area from 5 to 80% or after it has been hot-rolled at a temperature ranging from 150° to 600°C.

8 Claims, No Drawings

METHOD OF PRODUCING ALUMINUM COATED STEEL

DETAILED DESCRIPTION OF THE INVENTION

This invention relates to a method for producing aluminum coated steel by spraying aluminum on the surface of a steel substrate to improve the corrosion resistance and heat resistance of the steel.

As is known well, it has become common to provide a coating on a steel surface by the spraying of metals such as aluminum for corrosion protection. Conventional coatings obtained by the spraying of metals are, in general, adhered only mechanically to the surface of the steel substrate. Hence, the coatings may have poor adherence to the substrate and may tend to be peeled off during handling. Therefore, the coating process is always carried out after the structure is fully constructed or to the completely assembled article. Both the pretreatment of substrate and technique of spraying affect strongly the adherence of the spray coated film and the corrosion resistance of the spray coating. For this reason, the standards of spraying, e.g., JIS H-9301 and H-9300, specify in detail the pretreatment and other operations performed on the standard of substrate. According to these standards, satisfactory coatings can be provided when completely assembled articles are coated with aluminum; therefore, the standards are adopted generally. When steel plates or the like have such a coating applied to them followed by being either rolled or drawn, sufficient adhesion of coating to the substrate cannot be obtained.

Accordingly, it is an object of this invention to provide a method for overcoming such disadvantages spraying aluminum onto a steel surface which is maintained at a temperature ranging from 100° to 500°C. The steel surface may be cleaned, by grid- or shot-blasting or by picking, followed by rinsing with water or the like prior to the application of aluminum.

The aluminum coated steel obtained by spraying with aluminum in such a manner may be directly employed effectively. However, in order to use the aluminum coated products, e.g., wire and sheet, stock that need severe workability, it is preferable that the stock be aftertreated at a temperature ranging from 150° to 600°C for a period of time ranging from 3 minutes to 24 hours after the product is either cold-rolled to produce a reduction in area from 5 to 80% or hot-rolled at a temperature ranging from 150°to 600°C to obtain an aluminum coated steel stock having excellent corrosion resistance and workability. The heat treatment after the steel has been hot-rolled may be omitted sometime. This invention restricts the surface temperature of steel substrate to being within the range from 100° to 500°C during the aluminum-spraying operation. The higher the heating temperature is within said range, the better the properties such as the adhesion of the aluminum film to the steel substrate are. However, a temperature in excess of 500°C is unfavorable because of the tendency for oxidation to proceed rapidly and for scale to be formed on the steel surface before or during the spraying. At a temperature of less than 100°C, the adhesion of the coating to the steel substrate is insufficient.

According to this invention, the heating temperature during both the hot-rolling operation and the final heat treatment are specified to fall within the range from 150° to 600°C. A temperature of less than 150°C provides insufficient aluminum coating on the substrate and a temperature exceeding 600°C causes an alloy to form between the steel substrate and the aluminum coating. A cold-rolling operation which producea a reduction in area of less than 5% causes insufficient elimination of pinholes in the aluminum coating and a reduction in area of more than 80% increases the hardness of the rolled product and produces poor workability. A heating time of less than 3 minutes does not provide sufficient aluminum coating on the rolled products. On the other hand, a heating time of longer than 24 hours does not provide any additional improvement in the heat treating effect.

According to this invention, the aluminum coating formed by the spraying operation should have a thickness ranging from 30 to 300 microns. A coating having a thickness of less than 30 microns shows poor corrosion resistance as a substrate for subsequent coating with paints. When the coating has a thickness greater than 300 microns, high stresses are retained in the coating so that the coating may be peeled off when the aluminum coated steel is subjected to various processing steps.

This invention will be now illustrated by way of the following examples.

Example 1

Steel plates to be employed in a welded structure having a width of 2 meters, a length of 4 meters and a thickness of 12mm were grid-blasted and then heated rapidly to various temperatures in a heating furnace. Immediately after the heating, each plate, heated to a specified temperature as shown in Table 1, was passed through a spraying apparatus arranged with a plurality of wire feed spraying guns to spray aluminum on the entire surface of the steel plate by moving automatically a series of guns forwards and backwards perpendicularly to the passing direction of the steel plate. Test pieces were sampled from the aluminum coated steel plate and were subjected to an adhesion test, a 180°bending test in which the sample was bent around a curvature of 60mm at the center of test piece for examining the development of cracks on the bent portion and a pinhole test in which the test piece was immersed in pure water for 72 hours. Table 1 shows the test results for test pieces prepared according to this invention and for several comparative examples.

Table 1

| Heating temperature (°C) | Thickness of coating microns Average | Minimum | Adhesion (kg/cm²) | Bending test | Pinhole test |
|---|---|---|---|---|---|
| | Examples according to this invention | | | | |
| 120 | 70 | 60 | > 300 | ◎ | ○ |
| 200 | 40 | 35 | > 300 | ◎ | ○ |
| 200 | 100 | 90 | > 300 | ◎ | ○ |
| 200 | 250 | 220 | > 300 | ◎ | ○ |
| 300 | 100 | 90 | > 300 | ◎ | ○ |
| | Comparative examples | | | | |
| 20 | 100 | 90 | < 200 | Δ | ○ |
| 50 | 100 | 90 | < 200 | Δ | ○ |
| 600 | 70 | 60 | < 200 | X | X |

◎ No cracking can be observed at a magnification of 10 times on the bent portion
○ Insignificant cracks can be observed at a magnification of 10 times on the bent portion
Δ Cracks can be observed by the naked eye.
X Some peeling-off on the bent portion.
○ No pinholes.
Δ Insignificant pinholes.
X A number of pinholes.

EXAMPLE 2

Cold-rolled steel sheets of 1.0mm thickness were pretreated in various manners as shown later and were coated with aluminum in a thickness of 100 microns by flame spraying while maintaining the pretreated substrates at room temperature or at specified elevated temperatures as shown in Table 2. The aluminum coated sheets produced were subjected to a 180° bending test around a curvature of 4mm at the center of samples to examine the coating adhesion. The results obtained are shown in Table 2, wherein the pretreatment A was effected by degreasing with trichlene, B by degreasing with trichlene, pickling with hydrochloric acid, washing with water and drying, C by shot-blasting and D by polishing the plates with endless polishing paper.

Table 2

| | Temperature of substrate (°C) | Pretreatment | | | |
|---|---|---|---|---|---|
| | | A | B | C | D |
| Examples | 150 | ○ | ○ | ○ | ○ |
| | 200 | ○ | ○ | ◎ | ◎ |
| | 300 | ○ | ○ | ◎ | ◎ |
| | 400 | ◎ | ◎ | ◎ | ◎ |
| | 500 | ○ | ○ | ○ | ○ |
| Comparative examples | Room temperature | X | X | Δ | X |
| | 50 | X | X | Δ | X |

◎ No cracking can be observed at a magnification of 10 times on the bent portion.
○ Insignificant cracks can be observed at a magnification of 10 times on the bent portion.
Δ Cracks can be observed by the naked eye.
X Peeling-off on the bent surface.

As shown in Table 2, no peeling-off could be observed in the aluminum coating formed on the test pieces of the present invention while those of the comparative example were peeled off completely during the bending test. On the test pieces which were heated at 500°C, the adhesion was decreased to some extent as compared with those which were heated at 400°C. This effect resulted from the oxidation of the substrate steel sheet. When the substrate is sprayed with aluminum under a reducing atmosphere or an argon atmosphere, this effect disappears and coatings having good adhesion characteristics are obtained. When heated to a temperature higher than 600°C, an alloy layer of Fe and Al is formed which decreases the workability of the material.

EXAMPLE 3

Mild steel wire of 5mm diameter was gridblasted while being maintained at a temperature of 180°C and immediately after the pretreatment, the wire was sprayed with aluminum automatically from three directions around the wire resulting in a thickness of coating of 100 microns. The wire was subsequently heated to 300°C and hot-drawn through a die with a reduction in area of 25% and then cooled in the air.

When the aluminum coated and drawn wire was subjected to the 180° contact bending test and a twisting test of 10 twists, no peeling off could be observed and the wire showed good workability. The wire also had a good result in the immersion test in nitric acid wherein the dissolved amount was as low as that for aluminum wire.

EXAMPLE 4

Cold-rolled steel sheets of 1.0mm thickness were degreased with trichlene and pretreated as shown in Table 3. The pretreated plates were coated with aluminum in a thickness of 100 microns by flame spraying. Then the aluminum sprayed sheets were thermally treated and cold-rolled under the conditions as shown in Table 3. The cold-rolled sheets were subjected to a 90° repeated bending test and the 180°contact bending test for examining the adhesion characteristics of the coating. In order to determine the corrosion resistance, the cold-rolled sheets were subjected to a 5% salt spraying test according to JIS Z 2371.

Table 3 shows the test results on the test pieces from the sheets prepared according to this example and several comparative examples. The test pieces of this example show good results.

Table 3

| Pretreatment | Temperature of steel plate at spraying (°C) | Reduction in area (%) | After treatment: Rolled temperature (°C) | After treatment: Heat treating condition |
|---|---|---|---|---|
| Examples | | | | |
| Shot-blasting | 200 | 10 | Room temp. | 350°C × 5 hrs |
| " | 200 | 20 | " | " |
| " | 200 | 30 | " | " |
| " | 200 | 10 | " | 550°C × 10 min. |
| " | 200 | 20 | " | " |
| " | 200 | 30 | " | " |
| Pickling, rinsing and drying | 300 | 10 | Room temp. | 550°C × 10 min. |
| " | 300 | 20 | " | " |
| " | 300 | 30 | " | " |
| " | 300 | 30 | " | 350°C × 5 hrs |
| " | 300 | 30 | 300 | — |
| Comparative Examples | | | | |
| Shot-blasting | Room temp. | 10 | Room temp. | — |
| " | " | 10 | " | — |
| " | 200 | 3 | " | 550°C × 10 min. |
| " | 200 | 20 | " | — |

Table 3-continued

| Flection test, number of flexures | Bending test | Salt spraying test |
|---|---|---|
| >10 | ◎ | >1000 |
| >10 | ◎ | >1000 |
| >10 | ◎ | >1000 |
| >10 | ◎ | >1000 |
| >10 | ◎ | >1000 |
| >10 | ◎ | >1000 |
| >10 | ○ | >1000 |
| >10 | ○ | >1000 |
| >10 | ◎ | >1000 |
| >10 | ◎ | >1000 |
| >10 | ◎ | >1000 |
| Peeling-off of coating during rolling | | — |
| " | " | — |
| 3 | X | >1000 |
| 5 | X | >1000 |

◎ No cracking can be observed at a magnification of 10 times on the bent portion.
○ Insignificant cracks can be observed at a magnification of 10 times on the bent portion.
X Peeling-off on the bent surface.

What we claim is:

1. A method for preparing aluminum coated steel comprising the steps of heating and thereafter maintaining a surface of a steel substrate to be coated with aluminum at at a temperature ranging from about 100°C to about 500°C, spraying the surface with aluminum in a thickness ranging from about 30 micrometers to about 300 micrometers, heating the aluminum spray coated steel to a temperature ranging from about 150°C to a temperature at which alloy formation may be initiated, and hot-rolling the heated aluminum coated steel to a reduction in area ranging from about 5 percent to about 80 percent.

2. A method according to claim 1, wherein the spraying of aluminum is effected under a reducing atmosphere.

3. A method according to claim 1, wherein the spraying of aluminum is effected in an atmosphere of a gas selected from the group consisting of nitrogen an argon.

4. A method according to claim 1, wherein the surface of the steel substrate is cleaned by grid-blasting prior to being sprayed with aluminum.

5. A method according to claim 1, wherein the surface of the steel substrate is cleaned by shot-blasting prior to being sprayed with aluminum.

6. A method according to claim 1, wherein the surface of the steel substrate is cleaned by pickling, followed by rinsing with water prior to being sprayed with aluminum.

7. A method according to claim 1, wherein the aluminum coated steel is heated for a period of at least 3 minutes to soften and anneal the aluminum coated steel.

8. A method according to claim 7, wherein the heating of the steel substrate is effected at a temperature ranging from 120° to 400°C.

* * * * *